US008425011B2

(12) United States Patent
Holland et al.

(10) Patent No.: US 8,425,011 B2
(45) Date of Patent: Apr. 23, 2013

(54) INKJET PRINTING APPARATUS AND METHOD THEREOF

(75) Inventors: Bill Holland, Palo Alto, CA (US); Napolean Leoni, San Jose, CA (US); Omer Gila, Cupertino, CA (US); Eric G. Hanson, Burlingame, CA (US)

(73) Assignee: Hewlett-Packard Development Company, Houston, TX (US)

( * ) Notice: Subject to any disclaimer, the term of this patent is extended or adjusted under 35 U.S.C. 154(b) by 0 days.

(21) Appl. No.: 13/259,561

(22) PCT Filed: May 29, 2009

(86) PCT No.: PCT/US2009/045605

§ 371 (c)(1), (2), (4) Date: Sep. 23, 2011

(87) PCT Pub. No.: WO2010/138126

PCT Pub. Date: Dec. 2, 2010

(65) Prior Publication Data

US 2012/0013672 A1 Jan. 19, 2012

(51) Int. Cl.
*B41J 2/06* (2006.01)
*B41J 29/38* (2006.01)

(52) U.S. Cl.
USPC ..... 347/55; 347/16

(58) Field of Classification Search ..... None
See application file for complete search history.

(56) References Cited

U.S. PATENT DOCUMENTS

| | | | |
|---|---|---|---|
| 4,833,492 | A | 5/1989 | Damouth |
| 6,079,814 | A | 6/2000 | Lean et al. |
| 6,920,030 | B2 | 7/2005 | Chase |
| 2008/0001347 | A1 | 1/2008 | Krause et al. |

FOREIGN PATENT DOCUMENTS

| | | | |
|---|---|---|---|
| EP | 0473178 A2 | * | 3/1992 |
| JP | 06-246910 | * | 9/1994 |
| JP | 06-246910 A | | 9/1994 |
| JP | 11-281810 A | | 10/1999 |

OTHER PUBLICATIONS

International Search Report and Written Opinion received in PCT Application No. PCT/US2009/045605, mailed Jan. 11, 2010, pp. 10.

* cited by examiner

*Primary Examiner* — Geoffrey Mruk

(57) ABSTRACT

An inkjet printing apparatus includes a media transport unit to transport a print media along a print media transport path, at least one printhead assembly including an inkjet printhead having a plurality of nozzles to print on a select portion of the print media, the inkjet printhead forming a print region adjacent to the nozzles in an area between the printhead assembly and a print portion of the print media transport path, and at least one of an electrostatic discharge unit to neutralize a resulting electrical charge on at least the select portion of the print media before the at least select portion of the print media enters the print region and a neutralization unit to neutralize an electric field in the print region.

15 Claims, 8 Drawing Sheets

INKJET PRINTING APPARATUS AND METHOD THEREOF

BACKGROUND

Inkjet printing apparatuses print images on a print media such as paper by ejecting ink in the form of drops from an inkjet printhead to the print media. At times, the paper may become electrically charged due to tribocharging and produce an electric field from the inkjet printhead to the printing media. The presence of the electric field can cause droplets of ink to accumulate on the inkjet printhead eventually resulting in the ink clogging the inkjet printhead and dripping onto the print media. Thus, the print quality of the images is adversely impacted.

BRIEF DESCRIPTION OF THE DRAWINGS

Exemplary non-limiting embodiments of the general inventive concept are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. Referring to the attached figures:

DETAILED DESCRIPTION

Figure 1A:
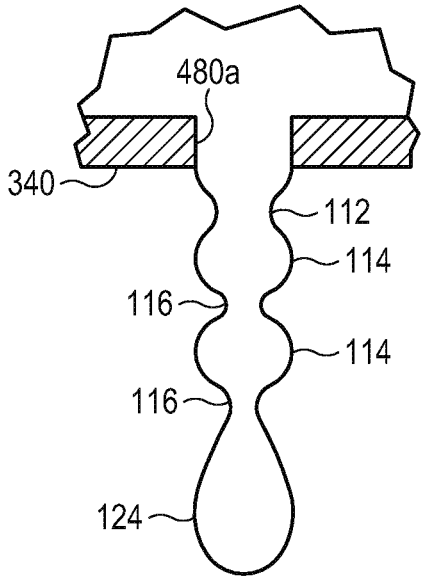
FIGS. 1A and 1B are side views of a representative nozzle of a portion of an inkjet printhead illustrating the formation of a drop and satellite droplets of ink over time according to an embodiment of the present general inventive concept.
Figure 1B:
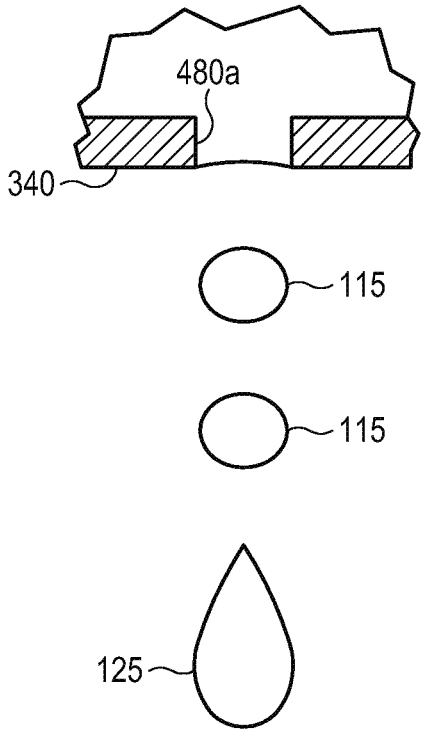

FIGS. 1A through 1B are side views of a representative nozzle 480*a* of a portion of an inkjet printhead 340 illustrating formation of a drop 125 and satellite droplets 115 according to an embodiment of the present general inventive concept. As illustrated in FIGS. 1A and 1B, the formation of a drop 125 of fluid such as ink from an inkjet printhead 340 generally results in the formation of unwanted meniscus droplets or satellite droplets 115. Referring to FIG. 1A, at a time $t_1$, as a drop emerges from a representative nozzle 480*a* of the inkjet printhead 340, the emerging drop 124 is elongated with a thinly-tapered tail that merges into a meniscus of the ink, for example, proximate to and/or inside the nozzle 480*a*. Fluid instabilities and surface tension forces, for example, at a junction 112 of the tail and the meniscus, where a fluid ejection velocity is near zero, initiate the formation of one or more emerging satellite droplets 114. Other junctions 116 may also be formed within the emerging drop 124.

Referring to FIG. 1B, at $t_2$, as the emerging drop 124 (FIG. 1A) breaks free of the meniscus, small satellite droplets 115 usually form. The drop 125 is ejected from the inkjet printhead 340 and travels to a print media 222 (FIG. 2) by momentum imparted to the drop 125 during ejection from the inkjet printhead 340. In contrast, the satellite droplets 115 tend to have small terminal velocities in air and are susceptible to being adversely impacted by electrostatic energy and air resistance. In one embodiment, the drop 125 may be in a range of, but is not limited to, 1 to 20 picoliters and the satellite droplets 115 may be in a range of, but are not limited to, 0.01 to 0.3 picoliters.

Figure 2:
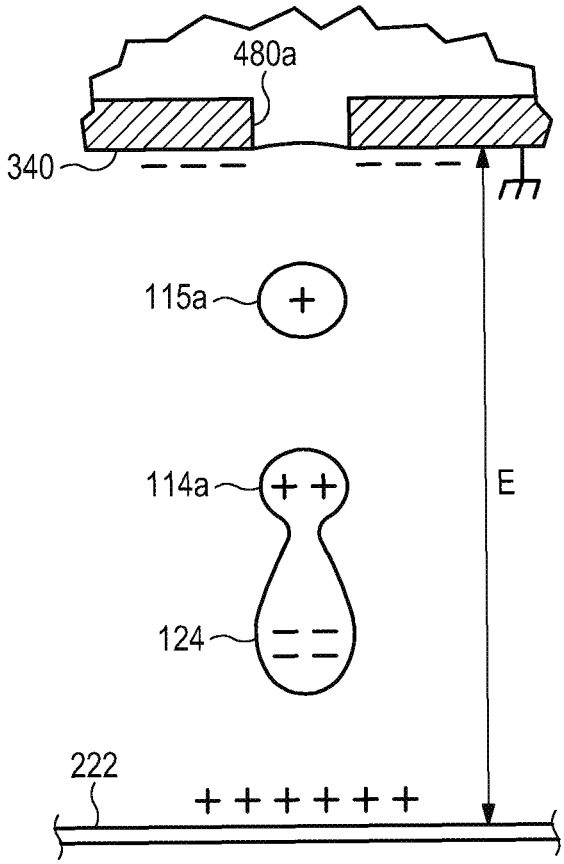
FIG. 2 is a side view of a representative nozzle of a portion of the inkjet printhead of FIG. 1 illustrating an electric field generated by an electrically-charged print media and its influence on an emerging drop, an emerging satellite droplet and a satellite droplet according to an embodiment of the present general inventive concept.

FIG. 2 is a side view of the representative nozzle 480*a* of a portion of the inkjet printhead 340 of FIG. 1 illustrating an electric field E generated by an electrically-charged print media 222 and its influence on an emerging drop 124, an emerging satellite droplet 114*a* and a satellite droplet 115*a* according to an embodiment of the present general inventive concept. The print media 222 may become electrically-charged, for example, as it is subjected to electrostatic energy as the print media 222 is transported throughout an inkjet printing apparatus. The electric field E generated by the electrically-charged print media 222 can extend from the print media 222 to the inkjet printhead 340 which generally is usually electrically grounded. The ink, for example, is a conductive fluid. Accordingly, the drop 125 (FIG. 1B) and satellite droplets 115 (FIG. 1B) contain mobile positive and negative electrical charges. In the presence of the electric field E, an electrical charge can be induced on portions of the emerging drop 124, the emerging satellite droplet 114*a* and the satellite droplet 115*a*.

For example, as illustrated in FIG. 2, a negative charge can be induced on one end of the emerging drop 124. That is, the end closest to the print media 222. Further, a positive charge can be induced in on another end of the emerging drop 124 including an emerging satellite droplet 114*a* to which the emerging drop 124 is still connected. That is, the end closest to the inkjet printhead 340. Referring to FIGS. 1B and 2, the drop 125 and the satellite droplet 115 will maintain the respective charges that existed while in the emerging drop state and emerging satellite droplet state, respectively, prior to being broke apart from each other. The electric field E generated by the print media 222 is likely not strong enough for the respective charges to cross air gaps.

Referring to FIGS. 1B and 2, the velocity of the drop 125 and its electrical charge will allow it to reach the print media 222. However, the smaller satellite droplets 115 that form as the drop 125 breaks free of the inkjet printhead 340 become charged to a same polarity as the print media 222. Further, movement of the satellite droplets 115 is primarily influenced by air flow patterns and electrostatic fields around the inkjet printhead 340 and print media 222, rather than the negligible gravitational forces and momenta. Consequently, the satellite droplets 115 are repelled back onto the electrically-grounded inkjet printhead 340 and form puddles of ink thereon. Furthermore, even in the absence of charges in the satellite droplets 115 the combination of the ink fluid dielectric constant k (e.g., as high as 80 for water based inks and at least 3 for many oils) and the non-uniform field in areas close to the inkjet nozzles will generate a net force attracting the satellite droplets 115 which may have a higher dielectric constant then the surrounding air towards areas where the electric field is non-uniform such as tips of the inkjet nozzle opening, again creating unwanted puddles of ink.

The puddles of ink on the inkjet printhead 340 tend to lead to ink clogging the nozzles and unwanted dripping on the print media. Thus, neutralizing or significantly diminishing the electrical field between the print media and the inkjet printhead may eliminate this unwanted effect. The electrical field can be neutralized, for example, by neutralizing the charge on the print media or by shunting the electric field from the respective charges through addition and strategic placement of additional grounding structures. Thus, exemplary embodiments of the present general inventive concept will be described below to illustrate neutralizing a resulting electrical charge on the print media prior to it passing under the inkjet printhead to be printed on or neutralizing the resulting electrostatic field between print media and inkjet printhead prior to the print media being printed on to prevent ink puddling and print quality from being adversely impacted.

Figure 3:
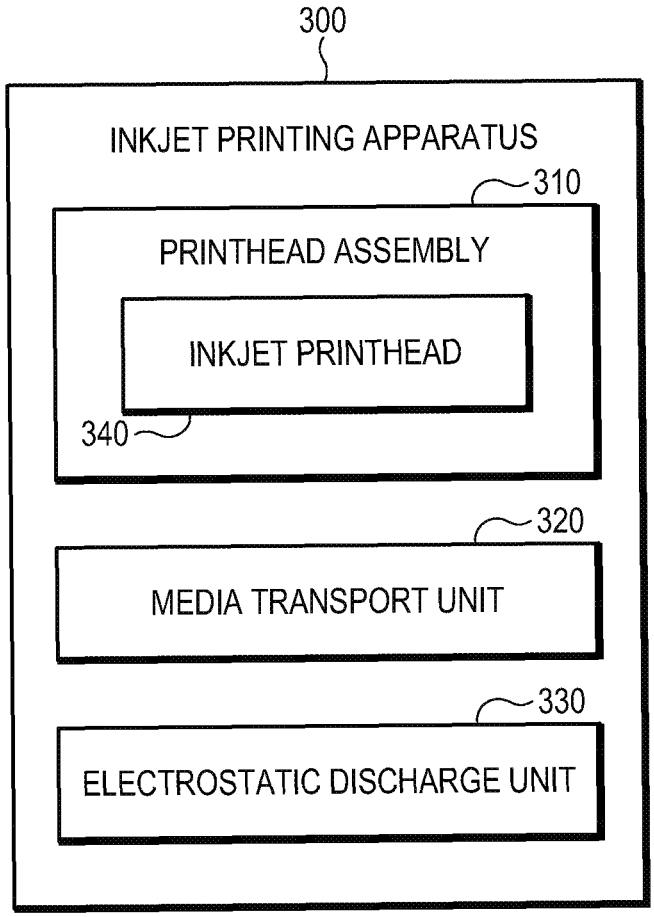
FIG. 3 is a block diagram illustrating an inkjet printing apparatus according to an embodiment of the present general inventive concept.

FIG. 3 is a block diagram illustrating an inkjet printing apparatus 300 according to an embodiment of the present general inventive concept. Referring to FIG. 3, an inkjet printing apparatus 300 includes a printhead assembly 310, a media transport unit 320, and an electrostatic discharge unit 330. In one embodiment, the printhead assembly 300 may include one or more inkjet printheads 340 to eject drops of fluid such as ink through a plurality of orifices or nozzles 480 (FIG. 2). In one embodiment, the drops of ink are directed toward a medium, such as a print media 444 (FIG. 2), so as to print onto a select portion of the print media 444. The nozzles 480 may be arranged in one or more columns or arrays such that properly sequenced ejection of ink from the nozzles 480 causes images to be printed upon the print media 444, for example, as the printhead assembly 310 and the print media 444 are moved relative to each other.

The printhead assembly 310 may include an ink supply within the printhead assembly 310 and/or be supplied to the printhead assembly 310 by an ink supply (not illustrated) as is well-known to one of ordinary skill in the art. For example, in one embodiment, the ink supply is housed within the printhead assembly 310. In another embodiment, the ink supply is separate from the printhead assembly 310 and supplies ink to the printhead assembly 310 through an interface connection, such as a supply tube. In such embodiments, the ink supply may be removed, replaced, and/or refilled.

Figure 4:
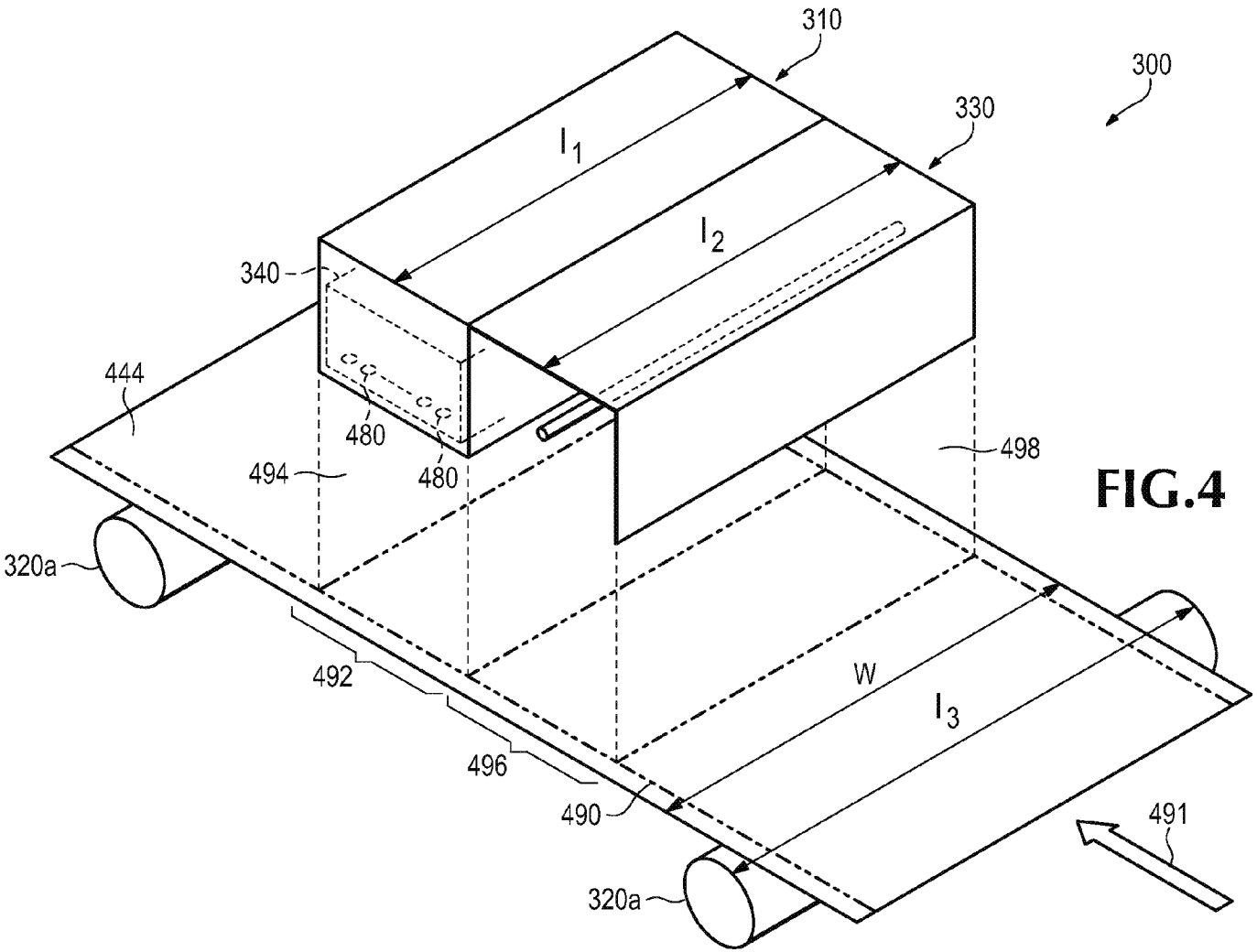
FIG. 4 is a perspective view illustrating an inkjet printing apparatus according to an embodiment of the present general inventive concept.

Referring to FIGS. 3 and 4, the media transport unit 320 transports the print media along a print media transport path 490 in a print media transport direction 491 through the inkjet printing apparatus 300. The print media 444 may include a continuous web print media such as a continuous roll of unprinted paper and cut-sheet material. The print media 444 may also include any type of suitable sheet material, such as paper, card stock, envelopes, labels, transparencies, and the like. The media transport unit 320 positions the select portion of print media 444 at a print portion 492 of the print media transport path 490 relative to the printhead assembly 310 to be printed upon. For example, if the print media 444 is a continuous web only a portion of the print media 444 may be able to be printed on at a time. Thus, in one embodiment, the select portion of the print media 444 is that portion of the print media 444 which can be printed on during a predetermined time interval. The predetermined time may be, for example, an amount of time for the printhead assembly 310 to print on a respective select portion of the print media 444 before another select portion of the print media 444 neutralized by the electrostatic discharge unit 330 is provided to the print region to be printed on.

The electrostatic discharge unit 330 generates positive and negative gas ions through air ionization and/or air breakdown to neutralize a resulting electrical charge on the print media 444 before the print media 444 is printed upon. The resulting electrical charge on the print media 444, for example, is a net difference between an amount of positive charge particles and negative charge particles. Neutralization of the resulting electrical charge on the print media 444 is achieved, for example, when a same amount of positive and negative charged particles are on the print media 444. Accordingly, the resulting electrical charge on the select portion of the print media is neutralized, when the select portion of the print media has the same number of positive and negative charge particles. Thus, in one embodiment, at least the select portion of the print media to be printed on is subject to neutralization by the electrostatic discharge unit 330 prior to the select portion being transported to the print region 494.

In one embodiment, the printhead assembly 310, the media transport unit 320, and the electrostatic discharge unit 330 may be attached to a frame of the inkjet printing apparatus 300. In another embodiment, the electrostatic discharge unit 330 may be attached to and/or part of the printhead assembly 310 (FIG. 4) such that the electrostatic discharge unit 330 is upstream of the inkjet printhead 340. That is, in a direction opposite to a print media transport direction 491. The print media transport direction 491 is a direction in which the print media 444 is transported to reach the printhead assembly 310 and/or a corresponding print region 494 (FIG. 4).

FIG. 4 is a perspective view illustrating the inkjet printing apparatus 300 of FIG. 3 according to an embodiment of the present general inventive concept. Referring to FIG. 4, an inkjet printing apparatus 300 includes a printhead assembly 310 including one or more inkjet printheads 340 to eject ink onto the print media 444. A print region 494 within which the printhead assembly 310 ejects drops of ink is defined adjacent to the nozzles 480 in an area between the printhead assembly 310 and the print portion 492 of the print media transport path 490.

Referring to FIG. 4, the media transport unit 320 transports the print media 444 along the print media transport path 490 in the print media transport direction through the inkjet printing apparatus 300. In one embodiment, the media transport unit 320 may include conductive transport rollers 320*a* disposed beneath the print media 444 that are electrically grounded. The media transport unit 320 allows the print media 444 to pass between the printhead assembly 310 and the media transport unit 320. Accordingly, a front side 444*a* (FIG. 8) of the print media faces the printhead assembly 310 and a back side 444*b* (FIG. 8) of the print media 444 faces the conductive transport rollers 320*a*.

As illustrated in FIG. 4, the inkjet printing apparatus 300 also includes an electrostatic discharge unit 330 to generate positive and negative gas ions through air ionization and/or air breakdown to neutralize the resulting electrical charge on the select portion of the print media 444 before the select portion of the print media 444 enters the print region 494. A neutralization region 498 within which the electrostatic discharge unit 330 generates positive and negative gas ions to neutralize the resulting electrical charge on at least the select portion of the print media 444 may be defined, for example, adjacent to a surface of the electrostatic discharge unit 330 facing a neutralization portion 496 of the print media transport path 490 in an area between the electrostatic discharge unit 330 and the neutralization portion 496 of the print media transport path 490. The electrostatic discharge unit 330 is disposed proximate to and upstream from the printhead assembly 310.

In one embodiment, the electrostatic discharge unit 330 can be proximate to, but separate from the printhead assembly 310 in a upstream direction to allow the neutralization region 498 to be upstream from the print region 494. In another embodiment, the electrostatic discharge unit 330 may be attached to and/or part of the printhead assembly 310 upstream of the print region 494. Thus, the neutralization region 498 may be upstream and adjacent to the print region 494. Accordingly, a distance between the neutralization region 498 and the print region 494 is reduced to prevent the select portion of the print media 444 from recharging itself due to electrostatic energy after leaving the neutralization region 498 and before entering the print region 494.

In one embodiment, a length, $l_1$, $l_2$, $l_3$, of the printhead assembly 310, electrostatic discharge unit 330, and the transport rollers 320*a*, respectively, correspond to or is greater than a width w of the print media 444 transverse to the print media transport direction 491. In another embodiment, $l_1$, $l_2$, $l_3$, may be less than w. In one embodiment, each of the inkjet printheads 340 may also extend across the width w of the print media 444. In other embodiments, a plurality of inkjet printheads 340 may be arranged side by side in order to extend across the width w of the print media 444.

Figure 5A:
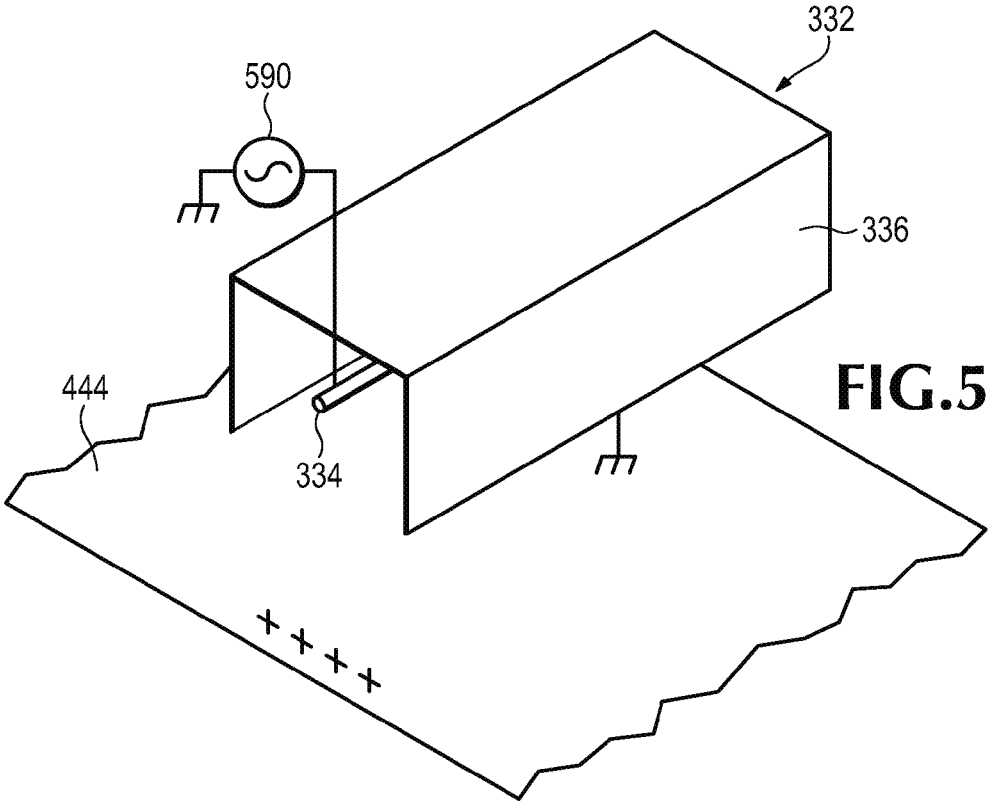
FIGS. 5A to 5C are perspective views illustrating an electrostatic discharge unit according to an embodiment of the present general inventive concept.
Figure 5B:
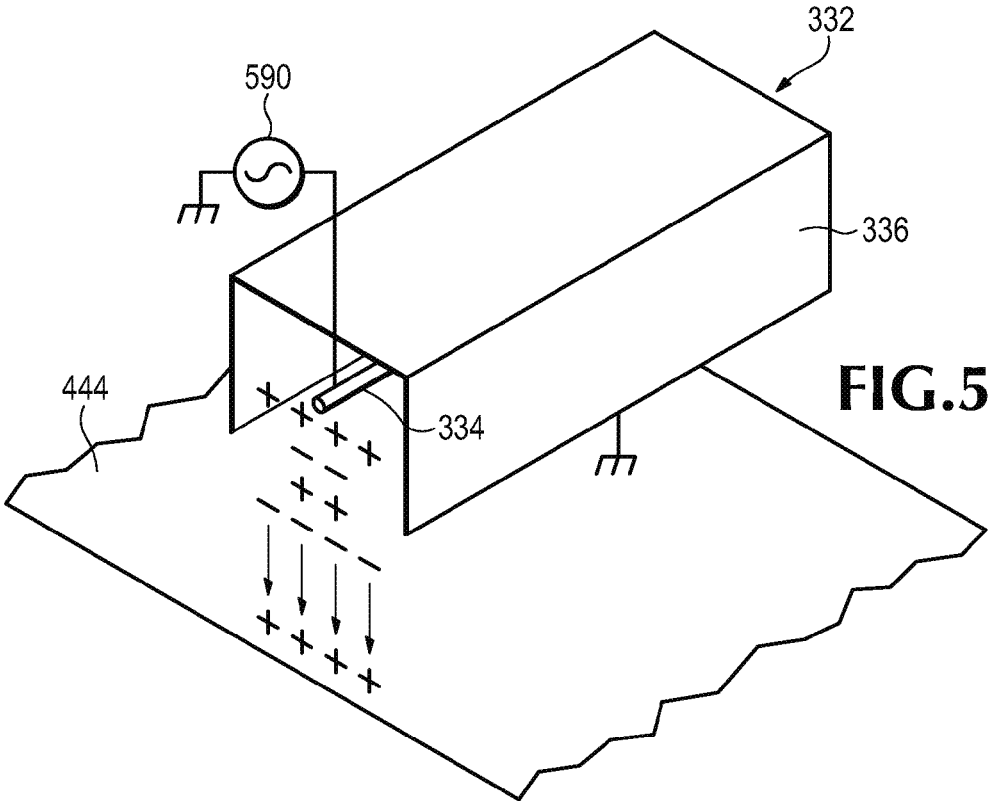
Figure 5C:
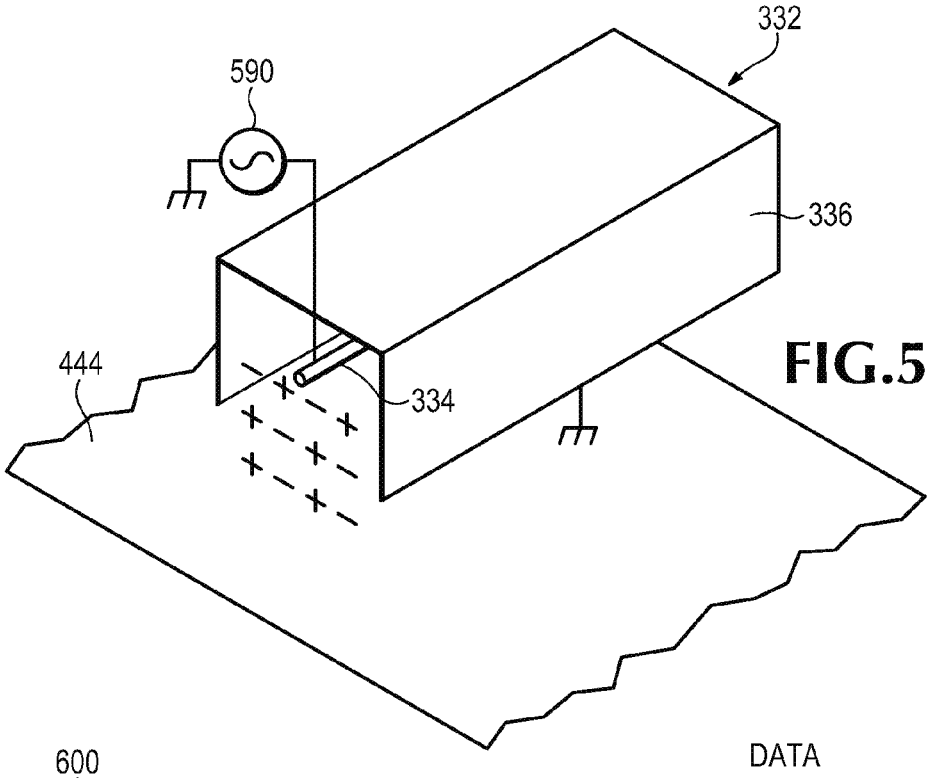

FIGS. 5A to 5C are side views illustrating an electrostatic discharge unit 330 (FIGS. 3 and 4) according to an embodiment of the present general inventive concept. The electrostatic discharge unit 330 may include, for example, an electrostatic discharge member proximately disposed to an electrically-grounded member to generate gas ions to neutralize the resulting electrical charge on the select portion of print media 444. In the present embodiment, the electrostatic discharge member is an alternate current (AC) corotron 332. The AC corotron 332 may include a corona wire 334 configured to receive high voltage AC 590 and a U-shaped metallic shield 336 partially covering the wire 334. In one embodiment, the wire 334 may be, but is not limited to, a 75 micron tungsten wire and receives a voltage in a range of, but is not limited to, 3 kV peak to 10 kV peak at a frequency in a range of, but not limited to, 1 kHz to 25 kHz. In the present embodiment, the electrically-grounded member is the u-shaped metallic shield 336 of the AC corotron 332.

As illustrated in FIGS. 5A-5C, in operation, a plurality of positive and negative ionized gas particles are produced inside the u-shaped metallic shell 336 and around the wire 334, essentially making the air around it conductive. If brought in proximity to the select portion of print media 444 in a charged state, the ionized gas particles will flow to neutralize the resulting electrical charge on the print media 444. Referring to FIG. 5B, as any charged area of the select portion of print media 444 passes under the AC corotron 332, charged particles of opposite sign are attracted to the select portion of print media 444 and charged particles of the same sign are attracted to the metallic shield 336, until no more charge remains on the select portion of print media 444 (FIG. 5C). Thus, if the select portion of print media 444 is positively charged, mobile negative charges move to the select portion of print media 444 and positive mobile charges move to the grounded surface until the resulting electrical charge on the select portion of print media 444 is neutralized. That is, an equal number of positive and negative charged particles exist on the select portion of the print media 444 as illustrated in FIG. 5C. Thus, the resulting electrical charge is neutral and the net electric field is approximately zero. Since the electric field is neutralize, satellite droplets 115 (FIG. 1B) are prevented from accumulating on the inkjet printhead 340 or other printer components. Accordingly, formation of ink that splatters on the print media 444 and puddles of ink on the inkjet printhead 340 that disrupt its operation are prevented.

Although the present embodiment illustrates the electrostatic discharge unit 330 as an AC corotron 332, in alternative embodiments, a discharge member to generate gas ions to neutralize electrostatic fields combined with an electrically-grounded member proximate to the discharge member are within the scope of the present general inventive concept. In other embodiments, the discharge member includes, but is not limited to, corotrons, scorotrons, electrostatic discharge needles, electrostatic discharge bars, and the like.

Figure 6:
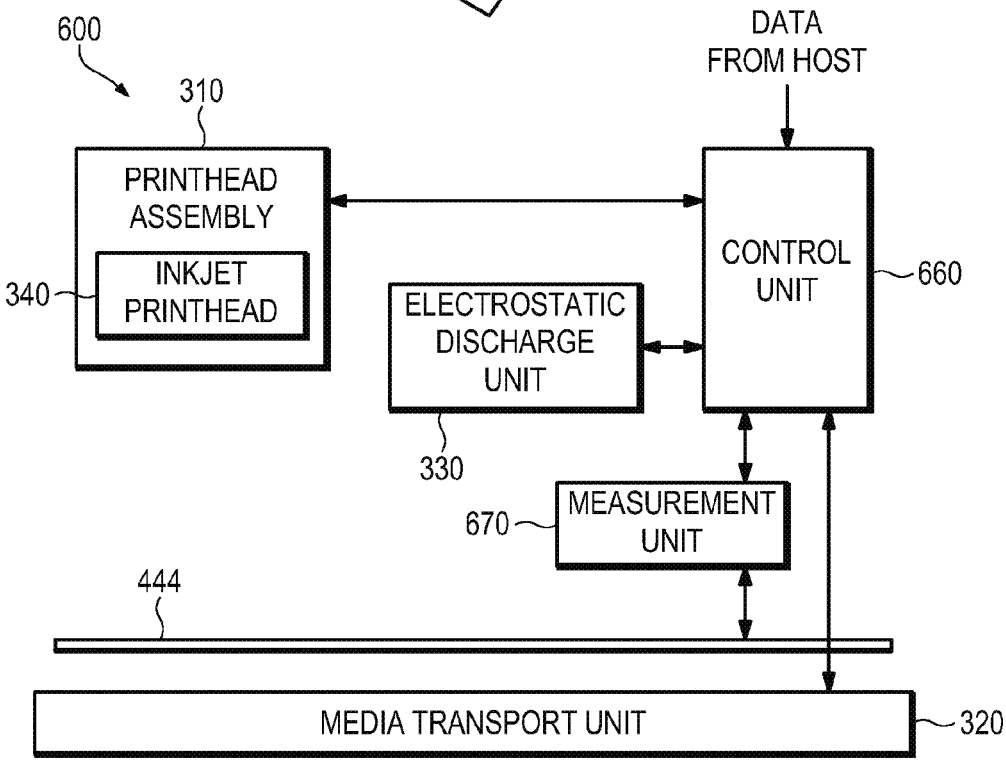
FIG. 6 is a block diagram illustrating an inkjet printing apparatus including a measurement unit and control unit according to an embodiment of the present general inventive concept.

FIG. 6 is a block diagram illustrating an inkjet printing apparatus 600 according to an embodiment of the present general inventive concept. Referring to FIG. 6, in the present embodiment, the inkjet apparatus 600 includes the printhead assembly 310, the media transport unit 320, and the electrostatic discharge unit 330 as previously described and illustrated in FIGS. 3 and 4. As illustrated in FIG. 6, in the present embodiment, the inkjet printing apparatus 600 may also include a control unit 660 and a measurement unit 670. The control unit 660 communicates with the printhead assembly 310, the media transport unit 320 and the electrostatic discharge unit 330. The control unit 660, for example, receives data from a host system, such as a computer, and may include memory to temporarily store data. The data may be sent to the inkjet printing apparatus 600 along an electronic, infrared, optical or other information transfer path. The data represents, for example, images to be printed. As such, the data forms a print job for the inkjet printing apparatus 600 and includes one or more print job commands and/or command parameters.

In one embodiment, the control unit 660 provides control of the printhead assembly 310 including timing control for ejection of drops of ink from the nozzles 480. As such, the control unit 660 defines a pattern of ejected drops of ink which form images on the select portion of print media 444. Timing control and, therefore, the pattern of ejected drops, is determined by the print job commands and/or command parameters. In one embodiment, logic and drive circuitry (not illustrated) forming a portion of the control unit 660 is located on the printhead assembly 310. In another embodiment, the logic and drive circuitry (not illustrated) forming a portion of the control unit 660 is located off the printhead assembly 310.

Referring to FIG. 6, the control unit 660 may also communicate with the electrostatic discharge unit 330 and the media transport unit 320. For example, the control unit 660 may change an ON/OFF state of the electrostatic discharge unit 330 based on a location of the select portion of print media 444 relative to the electrostatic discharge unit 330. In one embodiment, the control unit 660 may turn the electrostatic discharge unit ON if the print media 444 is proximate to or within range of the electrostatic discharge unit 330, and OFF if the print media 444 is not proximate to or in range of the electrostatic discharge unit 330. In another embodiment, the ON/OFF state of the electrostatic discharge unit 330 may correspond to an ON/OFF state of the inkjet printing apparatus 600. Thus, the electrostatic discharge unit 330 will also be placed ON when the inkjet printing apparatus 600 is placed ON, and will remain ON until the inkjet printing apparatus 600 is placed in an OFF state.

Referring to FIG. 6, the control unit 660 may control an amount of power provided to the electrostatic discharge unit 330 by a power supply (not illustrated) based on the resulting electrical charge on the select portion of print media 444. Thus, the control unit 660 may control an increase or decrease in an amount of charged ions generated by the electrostatic discharge unit 330 to neutralize the resulting electrical charge on at least the select portion of print media 444. For example, the control unit 660 may control the electrostatic discharge unit 330 to receive a predetermined amount of power for a predetermined resulting electrical charge on the select portion of print media 444. The resulting electrical charge and/or voltage of the at least select portion of print media 444 may be measured by a measurement unit 670. In one embodiment, the measurement unit 670 may be in contact with the at least select portion of the print media 444. The measurement unit 670 may include, for example, one or more electrostatic voltage measurement probes.

The control unit 660 may also control a speed in which the print media is transported by the media transport unit 320, for example, to change a duration in which the at least select portion of the print media 444 is being exposed to the electrostatic discharge unit 330. The speed may correspond to the resulting electrical charge on the at least select portion of the print media 444 measured by the measurement unit 670. For example, the control unit 660 may control the media transport unit 320 to transport the print media 444 at a predetermined speed for a predetermined resulting electrical charge on the select portion of the print media 444. In one embodiment, a lookup table which is well-known to one of ordinary skill in the art, can be used to store the various predetermined power levels and/or predetermined speeds that correspond to the various predetermined resulting electrical charges.

Figure 7:
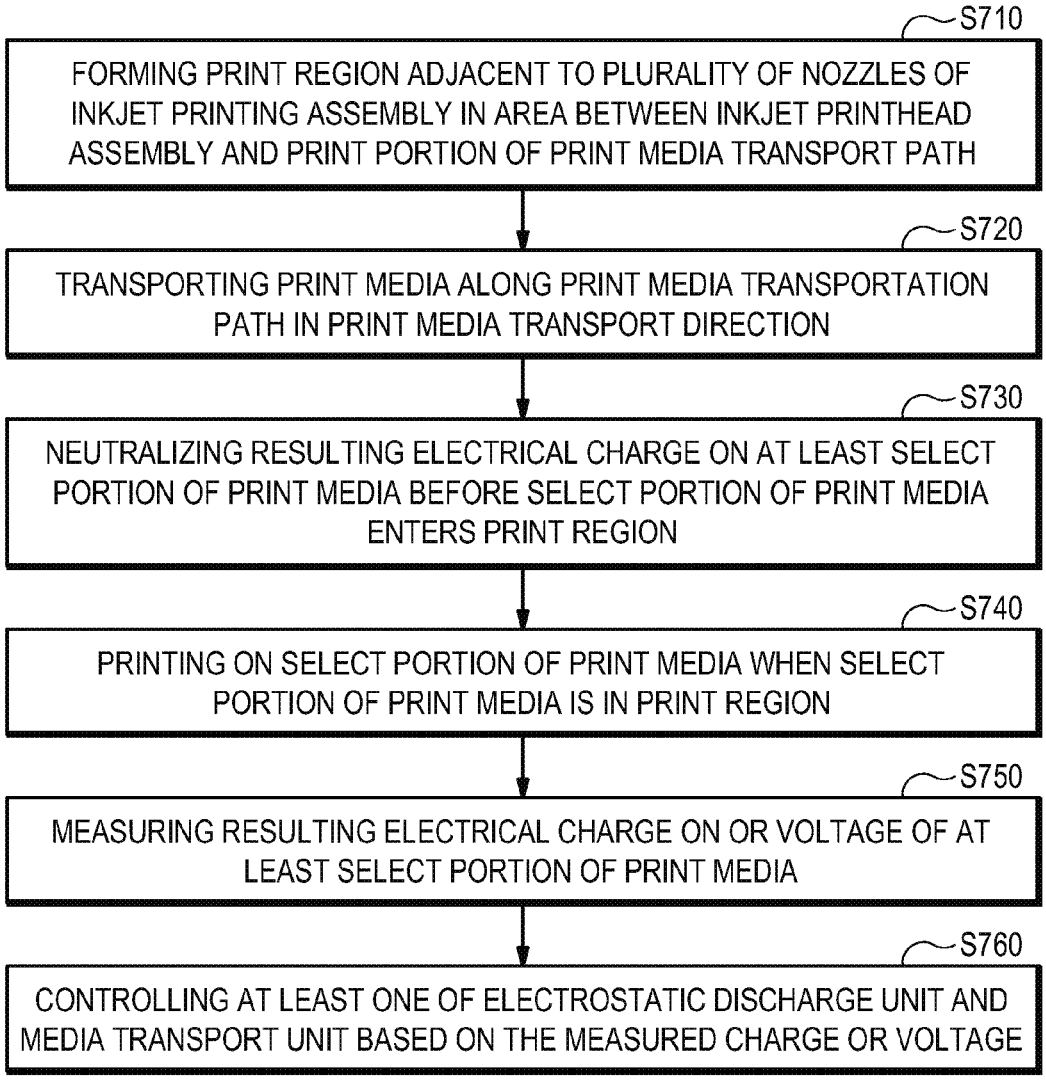
FIG. 7 is a flowchart illustrating an inkjet printing method according to an embodiment of the present general inventive concept.

FIG. 7 is a flowchart illustrating an inkjet printing method according to an embodiment of the present general inventive concept. Referring to FIGS. 3, 4 and 7, in operation S710, a print region 494 is formed adjacent to a plurality of nozzles 480 of a printhead assembly 310 in an area between the printhead assembly 310 and a print portion 492 of a print media transport path 490. In operation S720, a print media 444 is transported along the print media transport path 490 in a print media transport direction 491 by a media transport unit 320. In operation S730, a resulting electrical charge on at least a select portion of the print media 444 is neutralized before the select portion of the print media 444 enters the print region 494, for example, by an electrostatic discharge unit 330. In operation S740, the select portion of the print media 444 is printed on when the select portion of the print media 444 is in the print region 494, for example, by a printhead assembly 310 including an inkjet printhead 340 having a plurality of nozzles 480. Referring to FIGS. 6 and 7, in operation S750, the resulting electrical charge or voltage of the at least select portion of the print media 444 is measured, for example, by a measurement unit 670. In operation S760, at least one of the electrostatic discharge unit 330 and the media transport unit 320 is controlled, for example, by a control unit 660 based on the measured resulting electrical charge or voltage, for example, provided from the measurement unit 670. In one embodiment, the inkjet printing method may include the forming operation (S710), the transporting operation (S720), the neutralizing operation (S730), and the printing operation (S740). In another embodiment, the inkjet printing method may include the forming operation (S710), the transporting operation (S720), the neutralizing operation (S730), the printing operation (S740), the measuring operation (S750), and the controlling operation (S760).

Figure 8:
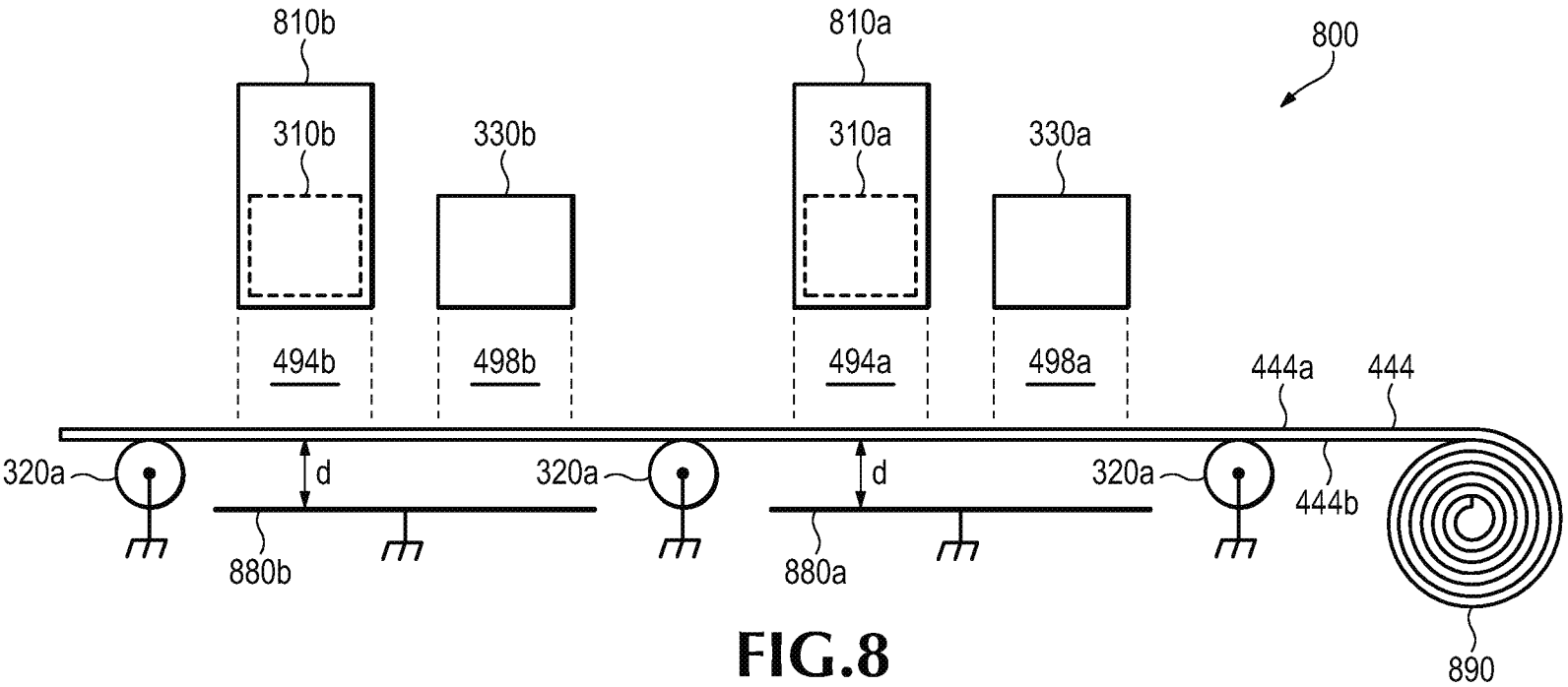
FIG. 8 is a side view illustrating an inkjet printing apparatus according to an embodiment of the present general inventive concept.

FIG. 8 illustrates a side view of an inkjet printing apparatus 800 according to an embodiment of the present general inventive concept. Referring to FIG. 8, the inkjet printing apparatus 800 includes a plurality of print stations 810*a* and 810*b*. The number of print stations 810*a* and 810*b* is not limited to two print stations, but may include one or more print stations. The print stations 810*a* and 810*b* may be configure to receive one or more inkjet printhead assemblies 310*a* and 310*b*, for example, as previously described and illustrated in FIGS. 3-5, to print on the select portion of the print media 444. For example, five print stations may be used such that each of the print stations includes a different color ink from each other such as cyan, yellow, magenta, blue and black. Referring to FIG. 8, the inkjet printhead apparatus 800 may also include, for each print station, a corresponding inkjet printhead assembly 310*a* and 310*b* having a corresponding print region, 494*a* and 494*b*, respectively, and an electrostatic discharge unit 330*a* and 330*b* having a corresponding neutralization region 498*a* and 498*b*, respectively, as previously described with reference to FIGS. 3 to 5C. In another embodiment, the inkjet printing apparatus 800 may also include a measurement unit 670 and control unit 660 as previously described with reference to FIGS. 6 and 7.

Referring to FIG. 8, in one embodiment, the inkjet printing apparatus 800 may also include one or more neutralization units. The neutralization unit may be, for example, conductive backing plates 880*a* and 880*b* that are electrically grounded and disposed opposite the back side 444*b* of the print media 444. Each of the conductive backing plate 880*a* and 880*b* may serve to establish and reduce an electrostatic voltage potential on the back side 444*b* of the print media 444 and, for example, neutralize the electric field E (FIG. 2) in the print region 494*a* and 494*b*. In one embodiment, the electric field E is neutralized prior to the print media 444 being printed on. For example, if the conductive backing plate 880*a* and 880*b* contacts the back side 444*b* of the print media 444, electrical charges from the back side 444*b* of the print media 444 may be electrically conducted from the print media 444 to the respective conductive backing plate 880*a* and 880*b*.

Alternatively, even if, for example, the conductive backing plate 880*a* and 880*b* does not contact the print media 444, a voltage on the back side 444*b* of the print media 444 can still be greatly reduced as compared to free space, if the conductive backing plate 880*a* and 880*b* is disposed in close proximity to the printing media 444. This is based on the relationship between capacitance C, voltage V and charge Q, that is $V=Q/C$, and the relationship between capacitance C, capacitor plate area A, a constant k, and plate distance d, that is $C=kA/d$, that are well-known to one of ordinary skill in the art. Thus, reducing the distance d causes a corresponding increase in capacitance C and, thus, a decrease in voltage V. The same principles that have been described with respect to the conductive backing plate 880*a* and 880*b* can also be applied to the conductive transport rollers 320*a* that are electrically-grounded.

Referring to FIG. 8, the inkjet printing apparatus 800 may include a supply roll 890 to spool a web of print media 444 to the media transport unit 320 to be transported through the inkjet printing apparatus 800. In another embodiment, single cut sheets of print media 444 are provided to the media transport unit 320. Thus, the supply roll would be replaced with a sheet feeder. In one embodiment, for example, the inkjet printing apparatus 800 may be a high speed inkjet press.

Referring to FIGS. 3, 4 and 8, in operation, the paper supply roll 890 supplies the print media 444 such as a web of paper to the media transport unit 320. The media transport unit 320 transports the print media 444 along the print media transport path 490 (FIG. 4) in a print media transport direction 491 in sequence from one print station 810*a* to another print station 810*b* through the inkjet printing apparatus 800. Each of the print stations 810*a* and 810*b* has a corresponding print region 494*a* and 494*b*, respectively, and a corresponding neutralization region 498*a* and 498*b*, respectively. When at least the select portion of the print media 444 is in the respective neutralization region 498*a* the corresponding electrostatic discharge unit 330*a* neutralizes the resulting electric charge on the at least select portion of the print media 444. Subsequently, the select portion of the print media 444 is transported into the respective print region 494*a* in a neutralized state and is printed on by the respective print station 810*a*. The print media 444 continues to be transported by the media transport unit 320 in sequence to each of the remaining print stations 810*b* so that the corresponding electrostatic discharge unit 330*b* of the respective print station 810*h* can perform the respective neutralizing operation and the print station 810*b* can perform the respective printing operation.

The present general inventive concept has been described using non-limiting detailed descriptions of embodiments thereof that are provided by way of example and are not intended to limit the scope of the general inventive concept. It should be understood that features and/or operations described with respect to one embodiment may be used with other embodiments and that not all embodiments of the general inventive concept have all of the features and/or operations illustrated in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the general inventive concept and which are described as examples. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. An inkjet printing apparatus, comprising:

a media transport unit to transport a print media along a print media transport path in a print media transport direction;

at least one inkjet printhead assembly including an inkjet printhead having a plurality of nozzles to print on a select portion of the print media, the inkjet printhead forming a print region adjacent to the nozzles in an area between the printhead assembly and a print portion of the print media transport path;

at least one of an electrostatic discharge unit to neutralize a resulting electrical charge on at least the select portion of the print media before the at least select portion of the print media enters the print region and a neutralization unit to neutralize an electric field in the print region;

a measurement unit disposed proximate to the at least select portion of the print media, and to measure the resulting electrical charge or voltage of the at least select portion of the print media; and a control unit to control at least one of the electrostatic discharge unit and the media transport unit based on the measured resulting electrical charge or voltage provided from the measurement unit.

2. The apparatus according to claim 1, wherein the electrostatic discharge unit forms a neutralization region adjacent to a surface of the electrostatic discharge unit facing a neutralization portion of the print media transport path in an area between the electrostatic discharge unit and the neutralization portion of the print media transport path.

3. The apparatus according to claim 2, wherein the neutralization region is adjacent to the print region with respect to the print media transport direction.

4. The apparatus according to claim 1, wherein the electrostatic discharge unit is attached to the print region with respect to the print media transport direction.

5. The apparatus according to claim 4, wherein the electrostatic discharge unit is an alternate current (AC) corotron having a wire and an electrically-grounded metallic shield partially covering the wire, the AC corotron is configured to receive high voltage AC.

6. The apparatus according to claim 1, wherein the neutralization unit comprises:

a conductive backing plate disposed opposite the at least one inkjet printhead assembly to allow the print media to pass between the at least one inkjet printhead and the conductive backing plate.

7. The apparatus according to claim 6, wherein the media transport unit comprises:

a plurality of conductive transport rollers.

8. The apparatus according to claim 7, wherein the inkjet printhead, the neutralization unit, and the media transport unit are electrically grounded.

9. The apparatus according to claim 1, wherein the measurement unit comprises:

at least one electrostatic voltage measurement probe in contact with the at least select portion of the print media.

10. The apparatus according to claim 1, further comprising:

a plurality of print stations, each of the print stations including a printhead assembly having one or more inkjet printheads to print on the select portion of the print media, wherein each of the print stations extends across a width of the print media.

11. The apparatus according to claim 10, wherein the inkjet printing apparatus is a high speed inkjet web press.

12. An inkjet printing apparatus, comprising:

a media transport unit to transport a print media along a print media transport path in a print media transport direction;

at least one inkjet printhead assembly including an inkjet printhead having a plurality of nozzles to print on a select portion of the print media, the inkjet printhead forming a print region adjacent to the nozzles in an area between the printhead assembly and a print portion of the print media transport path;

an electrostatic discharge unit to neutralize a resulting electrical charge on at least the select portion of the print media before the at least select portion of the print media enters the print region, the electrostatic discharge unit forming a neutralization region adjacent to a surface of the electrostatic discharge unit facing a neutralization portion of the print media transport path in an area between the electrostatic discharge unit and the neutralization portion of the print media transport path; and a measurement unit disposed proximate to the at least select portion of the print media, and to measure the resulting electrical charge or voltage of the at least select portion of the print media; and wherein the neutralization region is adjacent to the print region with respect to the print media transport direction.

13. The apparatus according to claim 12, further comprising:

a control unit to control at least one of the electrostatic discharge unit and the media transport unit based on the measured resulting electrical charge or voltage provided from the measurement unit.

14. The apparatus according to claim 12, wherein the measurement unit comprises:

at least one electrostatic voltage measurement probe in contact with the at least select portion of the print media.

15. An inkjet printing apparatus, comprising:

a media transport unit to transport a print media along a print media transport path in a print media transport direction;

at least one inkjet printhead assembly including an inkjet printhead having a plurality of nozzles to print on a select portion of the print media, the inkjet printhead forming a print region adjacent to the nozzles in an area between the printhead assembly and a print portion of the print media transport path; and a neutralization unit to neutralize an electric field in the print region, the neutralization unit including a conductive backing plate disposed opposite the at least one inkjet printhead assembly to allow the print media to pass between the at least one inkjet printhead and the conductive backing plate.

* * * * *

UNITED STATES PATENT AND TRADEMARK OFFICE

CERTIFICATE OF CORRECTION

PATENT NO. : 8,425,011 B2
APPLICATION NO. : 13/259561
DATED : April 23, 2013
INVENTOR(S) : Bill Holland et al.

It is certified that error appears in the above-identified patent and that said Letters Patent is hereby corrected as shown below:

On the Title page, in item (75), Inventors, in column 1, line 2, delete "Napolean" and insert -- Napoleon --, therefor.

Signed and Sealed this
Twenty-fourth Day of September, 2013

Teresa Stanek Rea
*Deputy Director of the United States Patent and Trademark Office*